US005347754A

United States Patent [19]

Jacob

[11] Patent Number: 5,347,754

[45] Date of Patent: Sep. 20, 1994

[54] POSITION SENSING APPARATUS

[75] Inventor: Steven D. Jacob, Roselle, Ill.

[73] Assignee: Landis & Gyr Powers, Inc., Buffalo Grove, Ill.

[21] Appl. No.: 60,099

[22] Filed: May 10, 1993

[51] Int. Cl.[5] ..... G08B 13/08

[52] U.S. Cl. ..... 49/13; 49/409; 454/61

[58] Field of Search ..... 454/56, 59, 61; 49/13, 49/14, 409

[56] References Cited

U.S. PATENT DOCUMENTS

| | | | |
|---|---|---|---|
| 4,893,551 | 1/1990 | Sharp et al. | 454/59 X |
| 5,090,304 | 2/1992 | Egbers et al. | 454/59 |
| 5,092,227 | 3/1992 | Ahmed et al. | 454/61 |
| 5,115,728 | 5/1992 | Ahmed et al. | 454/61 |

*Primary Examiner*—Harold Joyce
*Attorney, Agent, or Firm*—Greer, Burns & Crain, Ltd.

[57] ABSTRACT

Apparatus for use in determining the position of an object such as a sash door of a laboratory fume hood which has an elongated base member for attachment to the fume hood adjacent the sash doors. It includes an electrical switching means having an elongated electrical resistance means that provides a signal indicative of the position of a sash door, and an actuator means associated with each sash door adapted to move when the sash door is moved. The actuator means includes an actuator assembly positioned to operate the switching means at a switch location that varies as the sash door is moved. The actuator means includes a linkage means that permits accurate operation even though there is undesirable movement of the door relative to the base member.

25 Claims, 3 Drawing Sheets

POSITION SENSING APPARATUS

The present invention generally relates to an apparatus which determines the position of one or more structures that are generally moveable along a predetermined path. The present invention is particularly suited for use in determining the position of moveable doors, such as sash doors that are moveable in associated tracks of a laboratory fume hood.

Fume hoods are utilized in various laboratory environments for providing a work place where potentially dangerous chemicals are used, with the hoods comprising an enclosure having moveable doors at the front portion thereof which can be opened in various amounts to permit a person to gain access to the interior of the enclosure. The enclosure is typically connected to an exhaust system for removing any noxious fumes so that the person will not be exposed to them while performing work in the hood.

Fume hood controllers which control the flow of air through the fume hood have become more sophisticated in recent years, and are now able to more accurately maintain the desired flow characteristics to efficiently exhaust the fumes from the enclosure as a function of the desired average face velocity of the opening of the fume hood. The average face velocity is generally defined as the flow of air into the fume hood per square foot of open face area of the fume hood, and the controller must have an accurate indication of this open face value to attain the desired average face velocity.

The sash doors of fume hoods can be opened by raising them vertically, often referred to as the sash position, or some fume hoods have a number of doors that are mounted for horizontal sliding movement in typically two sets of tracks. Prior art fume hood controllers have included sensing means for measuring the absolute position of vertical doors or the relative positions of horizontal doors and then using a signal proportional to the sensed position to thereby vary the speed of the blowers or to vary the position of the dampers.

One system for determining the position of a moveable structure such as sash doors of a fume hood is disclosed in U.S. Pat. No. 5,090,304 by Egbers et al. The system disclosed therein includes electrical circuitry for providing signals indicating the position of the sash doors, and includes an electrical switching means to generate the signals.

It is a primary object of the present invention to provide an improved sensing apparatus for measuring the absolute position of moveable structures along a predetermined path.

Another object is to provide an improved sensing apparatus for use in determining the absolute position of sash doors in a laboratory fume hood.

A related object is to provide such an improved sensing apparatus that utilizes a switching means having an elongated electrical resistance means with a predetermined resistance value per unit length which can be operated by an actuator means that is associated with the sash door to indicate its position, whereby the apparatus uniquely permits variation of the movement of the sash doors along the track without detrimentally affecting the proper operation of the apparatus.

A more detailed object is to provide such an improved sensing apparatus that can be installed on and reliably operated on existing laboratory fume hoods in which the travel of the sash doors along their associated tracks is not precise because of the lack of close tolerances.

Stated in other words, it is an object of the present invention to provide such an improved sensing apparatus that can be used in installations where the sash doors have a considerable amount of play during movement of the doors, and the apparatus is not adversely affected by such looseness.

These and other objects will become apparent upon reading the following detailed description of the present invention, while referring to the attached drawings, in which.

DETAILED DESCRIPTION

Figure 1:
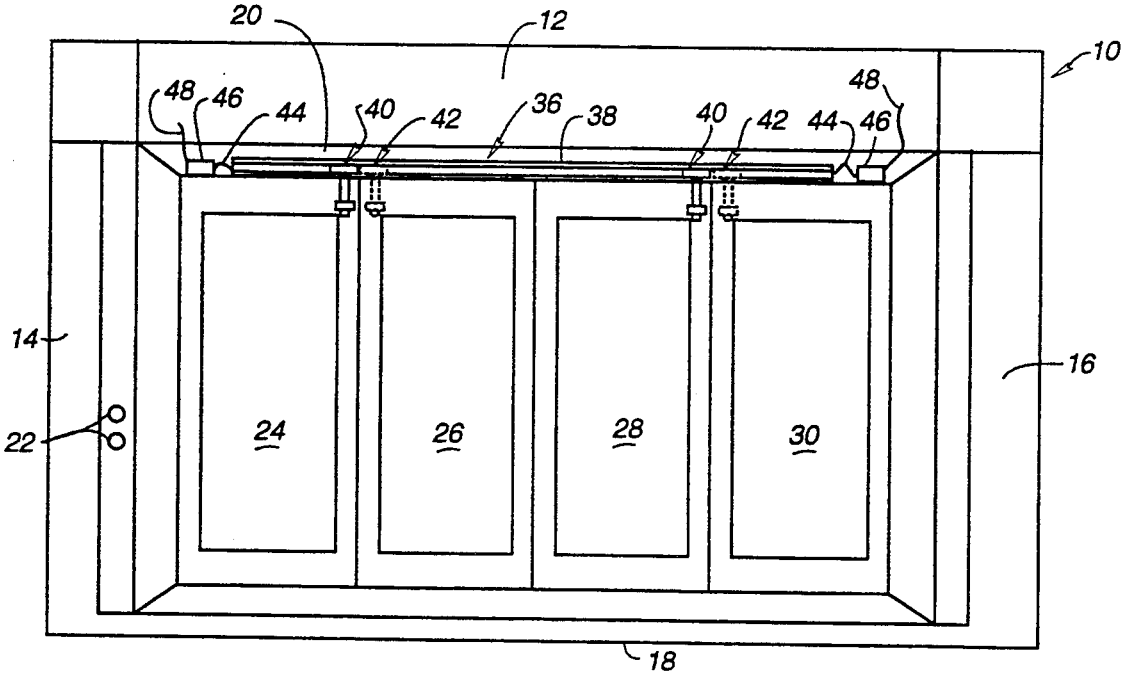
FIG. 1 is a front view of a laboratory fume hood having four horizontally movable sash doors, shown together with apparatus embodying the present invention.

The present invention is directed to a sensing apparatus that is particularly adapted for use in determining the position of a structure that is movable along a predetermined path. While the present invention is suited for many differing uses, where a structure is movable along a predetermined path such as a track and the position of the structure is intended to be sensed, the present invention is particularly adapted for use with laboratory fume hood sash door position determining systems.

In such systems, the position of the sash doors of the fume hood are desirably precisely determined so that a fume hood controller can accurately control the flow of air through the fume hood to desirably maintain a constant average face velocity of the effective opening of the fume hood. Since sash doors of laboratory fume hoods can either operate horizontally or vertically and sometimes in both directions, it is necessary to have a position determining apparatus that can effectively determine the vertical position as well as the horizontal position of such sash doors.

While it may be expected that a position sensing apparatus may be merely oriented in either the horizontal or vertical directions, the construction of the fume hoods and particularly the sash doors and their mounting structure can vary widely with different manufacturers, thereby complicating such simplistic expectation.

It is also desirable that a position determining apparatus be provided which can be installed on existing fume hoods that may be retrofitted with improved control apparatus. Such retrofit installations may be used in connection with fume hoods that are quite old and have considerable play in the movement of the sash doors relative to the frames. Therefore, the looseness of the movement of the sash doors along its track can cause severe problems with respect to a sensing device that requires physical contact of the sash doors relative to the stationary structure upon which the sensing apparatus is mounted.

In the aforementioned Egbers et al. U.S. Pat. No. 5,090,304, an actuator is installed in the sash doors and is resiliently mounted and intended to contact an elongated electrical switching means that is mounted adjacent the frame. Slight variations in the spacing between the sash door and the switching means can occur, but it has been found that for some installations, the play or looseness of the sash doors is sufficiently great that the actuator loses contact with the switching means during movement of the sash door, which thereby cause inaccurate sensing of the position of the sash doors.

Broadly stated, the sensing apparatus of the present invention has an elongated base member which contains an electrical switching means located within it, with the switching means having an elongated electrical resistance means with a predetermined resistance value per unit length. The apparatus has an actuator means associated with the base member and electrical switching means and includes a uniquely constructed linkage that is attached to the sash doors and which permits relative movement between the sash door and the base member without detrimentally affecting the operation of the sensing apparatus.

A novel feature of the present invention enables the linkage to have different shapes to facilitate application on different types of fume hoods where the orientation of the base member relative to the sash doors may be different. The novel actuator means construction permits such looseness or play in the sash doors relative to the base member regardless of the orientation of the base member relative to the sash doors. Moreover, the linkage itself is designed to permit limited flexure or movement at the location of attachment to each sash door relative to the actuator block in directions that do not affect the sensed position. However, it will not flex in the direction of movement along the track and will thereby not interfere with the accurate sensing of the sash door position.

Figure 2:
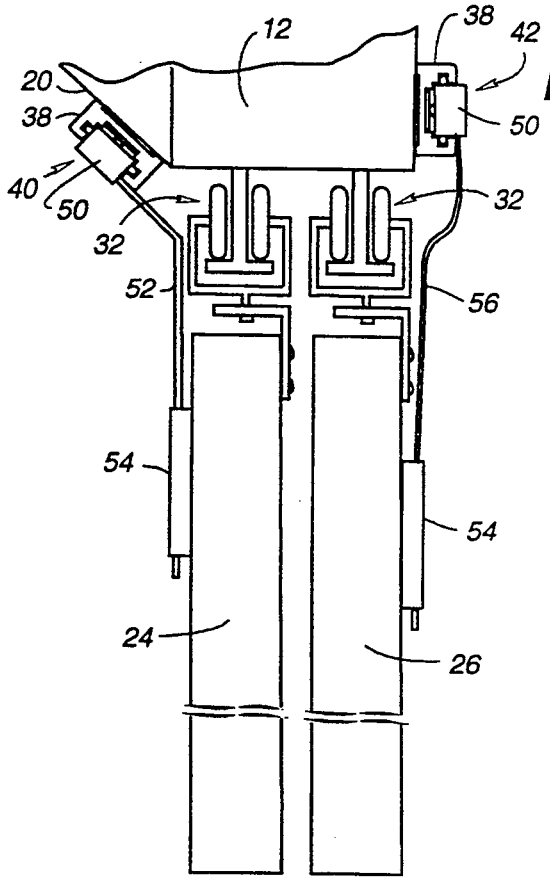
FIG. 2 is a diagrammatic end view of FIG. 1 showing a portion of the fume hood and apparatus embodying the present invention.

Turning now to the drawings, and particularly FIG. 1, a laboratory fume hood, indicated generally at 10, is shown to have an outer frame portion comprised of a top section 12, left and right sections 14 and 16, and a bottom section 18. The top section 12 also has an angled portion 20 which defines an air foil. Controls 22 are generally indicated and the fume hood has four doors 24, 26, 28 and 30, two of which are shown in FIG. 2 to ride on a guide and rail system, indicated generally at 32. The manner in which the fume hood sash doors are carried in the fume hood is not particularly important to the present invention except to the extent that the structure shows that the fume hood's sash doors travel along a track and can be moved in either the left or right direction. As indicated from viewing FIGS. 1 and 2, adjacent doors 24 and 26 do not ride in the same track but are in adjacent tracks so that both doors can be moved to the same horizontal position if desired.

The sensing apparatus embodying the present invention is shown having been installed on the fume hood shown in FIGS. 1 and 2, and is indicated generally at 36 in FIG. 1 and comprises an elongated base member 38 and a number of actuator assemblies 40 and 42, each of which is associated with one of the sash doors. The actuator assemblies 40 are shown associated with sash doors 24 and 28 while the actuator assemblies 42 are illustrated with sash doors 26 and 30. As can be seen in FIG. 2, the actuator assemblies 40 are mounted on the front side of the sash door air foil 20 whereas the actuator assemblies 42 are mounted inside the fume hood and are therefore shown in phantom in FIG. 1. Electrical conductors 44 extend from each end of the base member 38 to electrical boxes 46 and conductors 48 then extend from the box 46 to the controller circuitry of the fume hood.

As is best shown in FIG. 2, and which will be more comprehensively described, the actuator assembly 40 includes an actuator block 50 from which a linkage 52 extends downwardly and which is attached to the sash door 24 by linkage mounting block 54. The actuator assembly 42 is also attached to the sash door 26 by a linkage 56 and the linkage mounting block 54. The shape of the linkage 56 is different than that of linkage 52 because of the difference in the angular orientation of the two actuator assemblies 40 and 42. The actuator assembly 40 as well as the base member 38 is at an orientation of approximately 45° whereas the actuator assembly 42 as well as its associated base member 38 is generally vertically oriented. It should be understood that while only one base member 38 is shown in FIG. 1, there is another base member 38 mounted on the inside of the fume hood as is apparent from FIG. 2.

Figure 5:
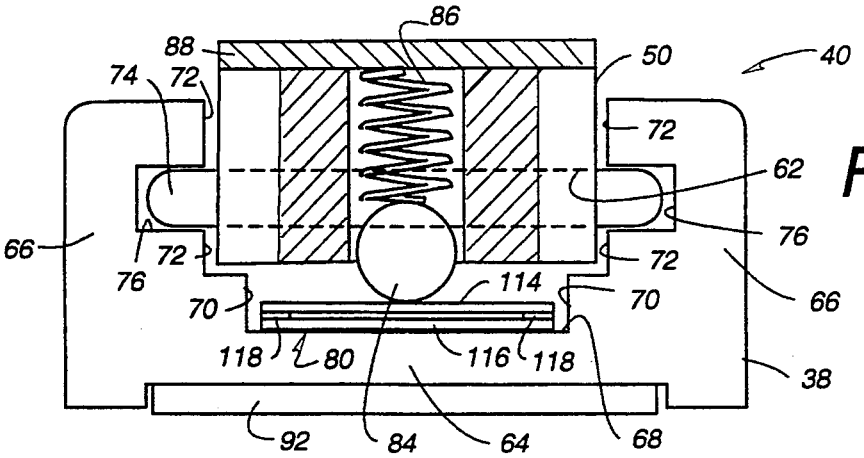
FIG. 5 is an end view, partially in section, of a portion of the apparatus embodying the present invention, and particularly showing the actuator means and base member embodying the present invention.
Figure 6:
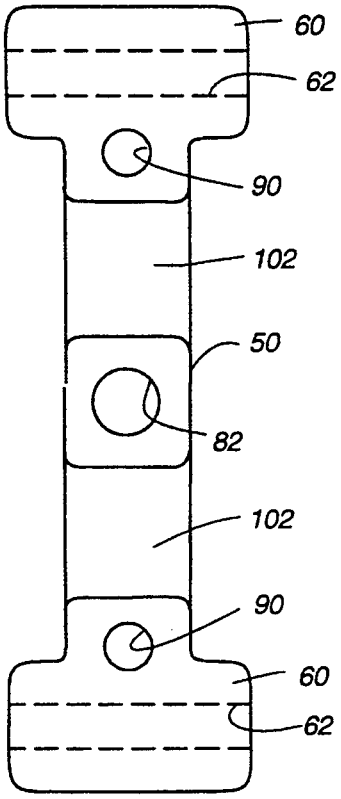
FIG. 6 is a top view of an actuator block that is a part of the present invention.
Figure 7:
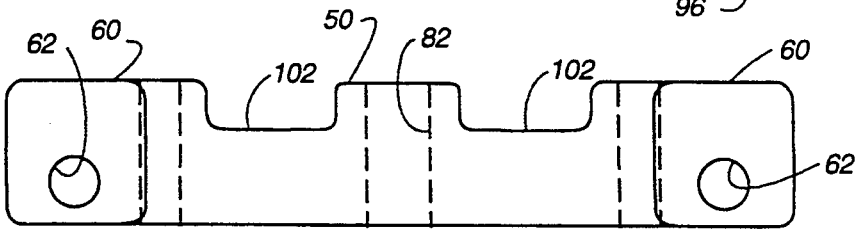
FIG. 7 is a side view of the actuator block shown in FIG. 6.

In accordance with an important aspect of the present invention, the construction of the base member 38 and the actuator assembly 40 or 42 is illustrated in FIGS. 5, 6 and 7. The actuator assembly 40 includes the actuator block 50 which is shown in detail in FIGS. 6 and 7 as well as in FIG. 5. The relative sizes of the views of the block in FIG. 5 versus FIGS. 6 and 7 is different to permit a more detailed depiction of other components in the drawing of FIG. 5. The block 50 has wider end portions 60 than the portion between the end portions 60. Each of the end portions 60 have a horizontal aperture 62 through which a dowel pin may extend for the purpose of retaining the actuator block within the base member 38.

In this regard, the base member 38 has a bottom portion 64 as well as side portions 66. The cross section of the base member 38 therefore has a bottom recess defined by a bottom surface 68 and side surfaces 70 in which an electrical switching means, indicated generally at 80, is located and which will be hereinafter described in detail. The side members 66 also have surfaces 72 which define a volume that is slightly larger than the width of the block 50 so that the actuator block 50 can move within the base member in its longitudinal direction.

The apertures 62 of the actuator block 50 each have a dowel pin 74 located within it and the dowel pin extends into a groove 76 that is formed in each of the side portions of the base member 38 as shown. The length of the dowel pin 74 extends beyond the side surfaces of the actuator block 50 to a depth that approaches the full depth of the opposed grooves 76. It is preferred that the dowel pins 74 which are located in opposite ends of the block 50 be lubricated, preferably with a Teflon lubricant so that the block will easily travel relative to the base member. It is also preferred that the dowel pins 74 have a diameter slightly smaller than the inside diameter of the apertures 62 so that they are relatively free to rotate within the actuator block 50.

The actuator block 50 has an aperture 82 preferably located in the center portion thereof which is adapted to receive an actuator member, preferably a ball 84 that is preferably made of stainless steel, and is slightly smaller than the diameter of the aperture 82. The ball 84 is biased into contact with the electrical switching means 80 by a spring biasing means, preferably a spring 86, that is retained at its top, as shown in FIG. 5, by a cover plate 88 that is attached to the block 50 by a pair of screws or the like (not shown) which are retained in threaded apertures 90 located at opposite end portions of the block as shown in FIG. 6. The spring is also preferably fabricated from stainless steel and it preferably supplies a force of approximately one-half pound which causes the ball 84 to actuate the switching means 80 as the actuator assembly 40 is moved relative to the base member 38.

The base member 38 is preferably attached to a suitable fume hood surface by an adhesive member 92. The adhesive member 92 fits within a slight recess. The adhesive member 92 preferably has adhesive on both sides to adhere the base member to the fume hood surface. It is preferred that a Teflon cover strip or the like cover the bottom surface of the adhesive member 92 until such time as the base member is to be installed whereupon the protective cover member can be removed to expose the adhesive surface for installation.

It should be understood that the cross section of the base member 38 as well as the overall size of the actuator block 50 is quite small which facilitates its easy application to many different kinds of fume hoods. It should be appreciated that if the structure is smaller in height and width, it may be installed in locations that may otherwise be prohibited. In this regard, it should be understood that the overall length of the block 50 is preferably approximately 1¼ inches, its width approximately 4/10 inch and its height approximately ¼ inch. The overall width of the base member 38 is approximately ⅓ inch and its height is approximately 3/10 inch. The overall size of the linkage mounting block 54 is preferably approximately 1 inch by 2¾ inches.

Figure 8:
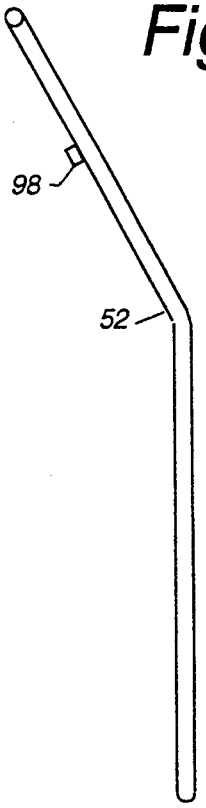
FIG. 8 is a side view of an embodiment of an actuator linkage.
Figure 9:
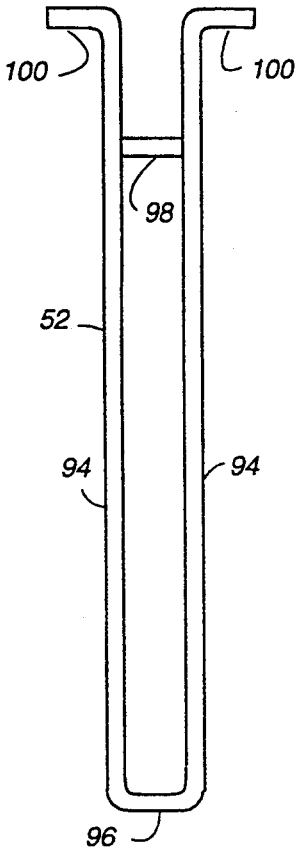
FIG. 9 is a side view of the linkage shown in FIG. 8.

In accordance with another important aspect of the present invention, the linkage 52 shown in FIGS. 8 and 9 is preferably fabricated from a type 302 stainless steel spring wire having a diameter of approximately 0.06 inch. The wire is bent to form two spaced apart segments 94 that are joined by a bridging portion 96 as well as by a separately attached brace portion 98 that is located near the opposite end. It is preferred that the brace support portion 98 be welded to the side segments 94. The linkage 52 has outward extensions 100 to retain the linkage in the actuator assembly after installation. In this regard, the actuator block 50 has a pair of recesses 102 that are adapted to receive one of the side segments 94 of the linkage 52. The outward extensions 100 prevent the linkage from being removed from the block when the cover 88 is attached to the block 50.

Figure 3:
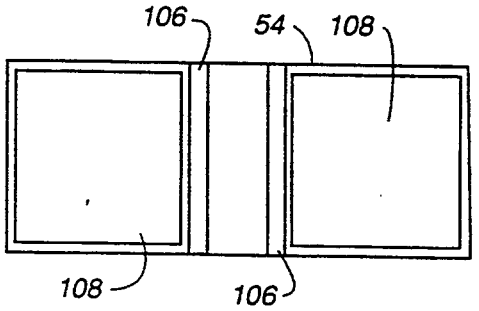
FIG. 3 is a bottom view of a sash linkage mounting block.
Figure 4:
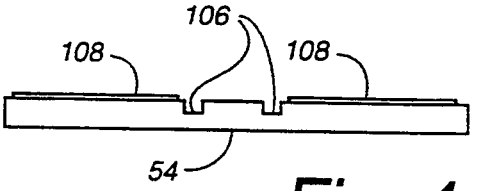
FIG. 4 is a side view of the mounting block shown in FIG. 3.

As shown in FIGS. 3 and 4, the linkage mounting block 54 has a generally rectangular configuration and has a pair of slots 106 that are spaced apart from one another a distance corresponding to the separation distance of the side segments 94 of the linkage. The linkage mounting block 54 also has double sided adhesive layers 108 for attaching the mounting block to the sash doors with the linkage located in the slots as shown in FIGS. 1 and 2.

Figure 10:
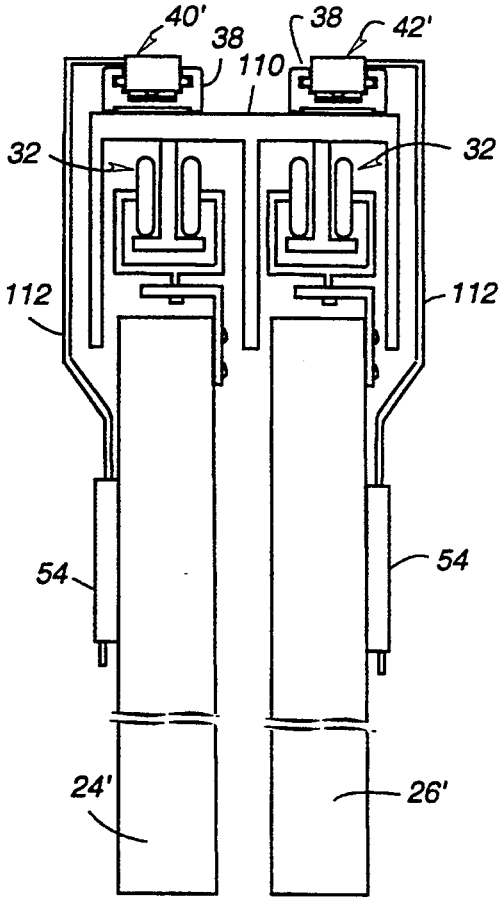
FIG. 10 is an end view of another laboratory fume hood shown with apparatus embodying the present invention installed thereon, similar to FIG. 2, but having a different mounting configuration.
Figure 11:
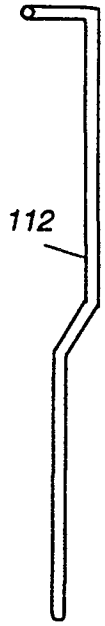
FIG. 11 is a side view of another embodiment of an actuator linkage.
Figure 12:
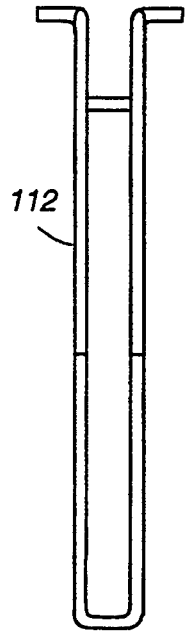
FIG. 12 is a front view of the linkage shown in FIG. 11.
Figure 13:
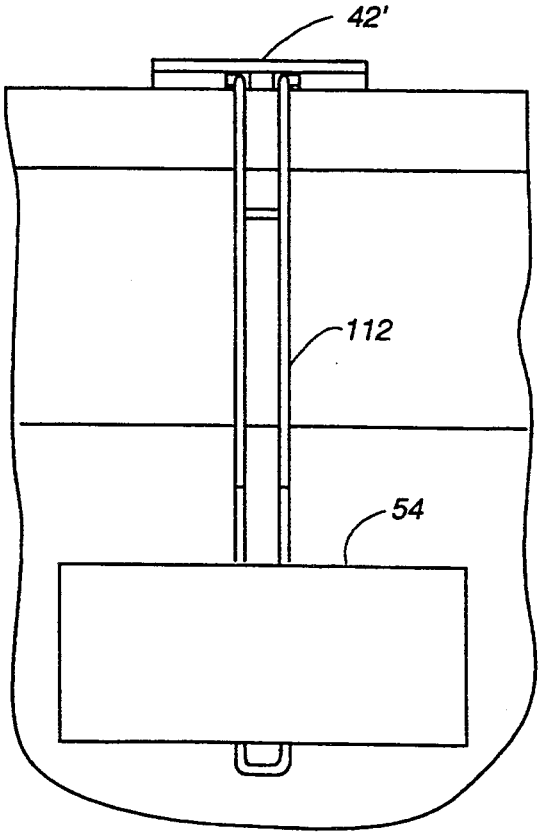
FIG. 13 is a side view of apparatus embodying the present invention installed on the laboratory fume hood shown in FIG. 10.

While the actuator assemblies 40 and 42 are shown at the respective angles of approximately 45° and vertical orientations, another type of fume hood is shown in FIG. 10 and it similarly includes a mounting structure 32, but it has a main frame 110 that includes a horizontal surface to which actuator assemblies 40' and 42' are mounted. The actuator assembly 40' is connected to a sash door 24' by a linkage 112 and linkage mounting plate 54. Similarly, the actuator assembly 42 is attached to sash door 26' by an identical linkage 112 and linkage mounting plate 54. The actuator assembly 42 is shown in side view in FIG. 13 and the shape of the linkage 102 is also shown in FIGS. 11 and 12.

In accordance with an important aspect of the present invention, the portion of the linkage which passes through the recesses 102 of the block 50 permit transverse movement, i.e., left and right as viewed in FIGS. 5, 6 and 10, for example. Also at the point of attachment of the linkage to the sash doors, the linkage mounting block 54 permits vertical movement of the linkage. However, due to the spaced apart construction of the side elements 94, they will be dimensionally stable and will not deflect in the direction of movement of the actuator assembly along the base member. In this regard, the linkages 56 and 112 are approximately 5 inches long although the length can be varied to accommodate particular applications. Because of the movement that is permitted in the connection of the linkage with the actuator block as well as the linkage mounting block, it should be understood that the operation of the switching means 80 will not be affected by looseness or play in the sash doors as they are moved along their respective tracks.

In connection with the electrical switching means 80 and referring to FIG. 5, it has a relatively simple mechanical design which is essentially the same as that disclosed in the aforementioned Egbers et al. U.S. Pat. No. 5,090,304. It preferably consists of a relatively thin polyester base layer 114, the lower surface of which has a strip of electrically resistive ink of a known constant resistance per unit length printed on it. Another polyester base layer 116 is provided and it has a strip of electrically conductive ink printed on its upper surface. The two base layers 114 and 116 are adhesively bonded to one another by two beads of adhesive 118 located on opposite sides of the strip. The base layers are preferably approximately five-thousandths of an inch thick and the beads are approximately two-thousandths of an inch thick, with the beads providing a spaced area between the layers 114 and 116. The switching mechanism 80 is preferably attached to the bottom portion 64 by adhesive (not shown), such as a thin layer of material having adhesive applied to both sides.

The polyester material is sufficiently flexible to enable one layer to be moved toward the other so that contact is made in response to the ball 84, so that when the sash door is moved, the ball 84 moves along the switching mechanism 80 and provides contact between the resistive and conductive layers which are then sensed by electrical circuitry, which provides a voltage output that is indicative of the position of the actuator means 40 along the length of the switching means.

From the foregoing description, it should be understood that an improved apparatus for use in determining the position of sash doors of a fume hoods has been shown and described which has many advantages and desirable attributes. While it has been described in an application whereby the position of sash doors of a fume hood are being determined, it has other applications where the position of an article that is moveable along a predetermined path is desired. Of particular benefit is the manner in which the linkage can float relative to the sash door and the actuator block, so that operation of the electrical switching means is not compromised by any play or loose fitting condition of the sash door in its track. The capability of various embodiments of the linkage permits the apparatus to be mounting in various orientations ranging from vertical to horizontal.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. Apparatus for sensing the position of at least one sash of a laboratory fume hood that is moveable along a track, said apparatus comprising:

an elongated base member adapted to be attached to the fume hood adjacent and parallel to one direction of possible movement of at least one of the sash doors;

an electrical switching means having an elongated electrical resistance means with a predetermined resistance value per unit length attached to said base member;

actuator means associated with said one sash door and being adapted to move when said sash door is moved, said actuator means including an actuator assembly positioned to operate said switching means at a switch location that varies along the length of the resistance means as said sash door is moved;

said actuator assembly being coupled to said base member and adapted to move relative thereto, said actuator means including a linkage means that extends to said sash door and attachment means for attaching said linkage means to said sash door.

2. Apparatus as defined in claim 1 wherein said linkage means comprises an elongated structure having one end portion attached to said actuator assembly and an opposite end portion attached to said sash door, said attachment means attaching said linkage means to said sash door in a manner whereby vertical movement of said linkage means relative to said sash door can occur during sliding movement of said sash door along its track.

3. Apparatus as defined in claim 2 wherein said actuator assembly includes means for connecting said linkage means thereto to permit relative movement between the same in a direction transverse to the direction of movement of the actuator means relative to said base member.

4. Apparatus as defined in claim 2 wherein each of said end portions have a slidable attachment which permit relative movement between the same in a direction transverse to the direction of movement of the actuator means relative to said base member.

5. Apparatus as defined in claim 2 wherein said attachment means comprises a mounting block having at least one recess in which said linkage means is retained, said recess permitting sliding movement of said linkage means in a vertical direction relative to said mounting block, and means for securing said mounting block to said sash door.

6. Apparatus as defined in claim 5 wherein said securing means comprises an adhesive layer.

7. Apparatus as defined in claim 2 wherein said elongated member is substantially rigid and has a width substantially greater than its thickness, the width substantially preventing flexure in the widthwise direction, so that movement of said sash door will substantially produce corresponding movement of said actuator assembly along said base member.

8. Apparatus as defined in claim 7 wherein said elongated member comprises a pair of spaced apart metal segments that are attached together at least at one end portion.

9. Apparatus as defined in claim 8 wherein said elongated member is formed of stainless steel wire that is bent to provide a connecting portion at said one end portion, said elongated member also having a stabilizing bridge portion interconnecting said metal segments near the opposite end portion thereof.

10. Apparatus as defined in claim 1 wherein said base member comprises a bottom portion and spaced apart transversely extending side portions, said side portions having inside grooves opposing one another and extending substantially the length of said base member, said electrical switching means being attached to the inside of said bottom portion.

11. Apparatus as defined in claim 10 wherein said actuator assembly includes an elongated actuator block that is sized to fit between said side portions of said base member, said actuator assembly includes outward extensions located at each end portion for engaging said grooves of said side portions and thereby slidably retaining said actuator assembly in said base member.

12. Apparatus as defined in claim 11 wherein said actuator block has a pair of apertures located in opposite end portions thereof, said outward extensions comprising a pair of dowel pins which are located in said apertures, each of said dowel pins extending nearly to the full depth of the opposed grooves.

13. Apparatus as defined in claim 12 wherein said dowel pins are rotatable in the apertures and are metal.

14. Apparatus as defined in claim 11 wherein said actuator block has an actuator aperture in a bottom side that is exposed to said electrical switching means, said actuator assembly further including an actuator member located in said actuator aperture and means for biasing said actuator member toward said electrical switching means, said biasing means applying sufficient force to said actuator member that said electrical switching means is switched at the location where said actuator member contacts the same.

15. Apparatus as defined in claim 14 wherein said actuator member comprises a ball and said biasing means comprises a coil spring.

16. Apparatus as defined in claim 14 wherein said actuator aperture extends through the actuator block, said actuator assembly further includes an actuator cover attached to the top surface of said actuator block, said cover retaining said biasing means in said actuator aperture.

17. Apparatus as defined in claim 16 wherein said actuator block includes at least one recess in the top side which extends between each side thereof, said recess being sized to receive said linkage means, said actuator cover extending over said recess to retain said linkage means.

18. Apparatus as defined in claim 17 wherein said actuator block includes a recess located on each side of said actuator aperture, each recess being adapted to receive a portion of said linkage means.

19. Apparatus for use with a position sensing system which includes an electrical switching means having an elongated electrical resistance means that generates a position generating electrical signal for a structure that is moveable along a predetermined path, said apparatus comprising:

an elongated base member for attachment adjacent the structure and said path, said base member having a bottom portion and spaced apart transverse side portions;

actuator means associated with and being adapted to move when said structure is moved, said actuator means including an actuator assembly positioned to operate said switching means at a switch location that varies along the length of the resistance means as said structure is moved;

said actuator assembly being connected to be retained by said base member and moveable relative to said base member, said actuator means including a linkage means that extends to and is attached to said structure.

20. Apparatus as defined in claim 19 wherein said linkage means comprises an elongated member having one end portion attached to said actuator assembly and an opposite end portion attached to said structure, at least one of said end portions having a slidable attachment to one of said structure and said actuator assembly to permit relative movement between the same in a direction transverse to the direction of movement of the actuator means relative to said base member.

21. Apparatus as defined in claim 20 wherein each of said end portions have a slidable attachment which permit relative movement between the same in a direction transverse to the direction of movement of the actuator means relative to said base member.

22. Apparatus as defined in claim 19 wherein said side portions of said base member have opposed inside grooves, said actuator assembly including an elongated actuator block that is sized to fit between said side portions of said base member, said actuator assembly including outward extensions located at each end portion for engaging said grooves of said side portions and thereby slidably retaining said actuator assembly in said base member.

23. Apparatus as defined in claim 22 wherein said actuator block has a pair of apertures located in opposite end portions thereof, said outward extensions comprising a pair of dowel pins which are located in said apertures, each of said dowel pins extending nearly to the full depth of the opposed grooves.

24. Apparatus as defined in claim 22 wherein said actuator block has an actuator aperture in a bottom side that is exposed to said electrical switching means, said actuator assembly further including an actuator member located in said actuator aperture and means for biasing said actuator member toward said electrical switching means, said biasing means applying sufficient force to said actuator member that said electrical switching means is switched at the location where said actuator member contacts said electrical switching means.

25. Apparatus as defined in claim 24 wherein said actuator member comprises a ball and said biasing means comprises a coil spring.

* * * * *

UNITED STATES PATENT AND TRADEMARK OFFICE

CERTIFICATE OF CORRECTION

PATENT NO. : 5,347,754
DATED : September 20, 1994
INVENTOR(S) : Steven D. Jacob

It is certified that error appears in the above-indentified patent and that said Letters Patent is hereby corrected as shown below:

Column 5, line 50, delete "1/3" and insert --2/3--.

Signed and Sealed this

Twenty-fifth Day of April, 1995

*Attest:*

Bruce Lehman

BRUCE LEHMAN

*Attesting Officer*

*Commissioner of Patents and Trademarks*